US006261108B1

(12) United States Patent
Kanagawa et al.

(10) Patent No.: US 6,261,108 B1
(45) Date of Patent: Jul. 17, 2001

(54) SHIELD CONNECTOR

(75) Inventors: Shuichi Kanagawa; Ichiaki Sano; Takao Nozaki, all of Nagoya (JP)

(73) Assignees: Harness System Technologies Research, Ltd., Aichi; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/517,626

(22) Filed: Mar. 3, 2000

(30) Foreign Application Priority Data

Apr. 15, 1999 (JP) ..... 11-108050
Feb. 24, 2000 (JP) ..... 00-046947

(51) Int. Cl.[7] ..... H01R 13/648
(52) U.S. Cl. ..... 439/98; 439/98
(58) Field of Search ..... 439/98, 99, 610, 439/188, 578, 603, 100, 108

(56) References Cited

U.S. PATENT DOCUMENTS 5,691,506 * 11/1997 Miyazaki ..... 174/65 R

FOREIGN PATENT DOCUMENTS 198 29 291 A1 2/1999 (DE) .
11-026093 1/1999 (JP) .

* cited by examiner

*Primary Examiner*—Kheim Nguyen
*Assistant Examiner*—Chaudrika Prasad
(74) *Attorney, Agent, or Firm*—Oliff & Berridge, PLC

(57) ABSTRACT

A shield connector is configured in a manner that a flange to be fixed to a partner-side wall is made conductive, and the shield layer of a shield wire is electrically connected to the conductive sleeve which is integrated with the flange. Thus, the configuration for electrically connecting the shield layer and the partner-side wall is simplified and the number of parts of the shield connector can be reduced.

21 Claims, 10 Drawing Sheets

SHIELD CONNECTOR

BACKGROUND OF THE INVENTION

The present invention relates to a shield connector.

FIGS. 10 and 11 show an example of a conventional shield connector disclosed in the Unexamined Japanese Patent Application No. Hei 11-26093. This shield connector includes a rubber ring 2, a holding ring 3, a conductive sleeve 4 and a pressing ring 5 within a cylindrical resin housing 1. A shield wire 10 is passed through these elements and attached thereto. A conductive contact piece 6 is disposed on the outer peripheral surface at the front end of the resin housing 1 in a manner that the conductive contact piece is electrically coupled to the shield layer 13 of the shield wire 10 through the conductive sleeve 4. A flange 7 formed at the resin housing 1 so as to expand therefrom is pressed and bolted to the opening edge of an attachment hole formed at the shielding wall of a not-shown electric device. Thus, the conductive contact piece 6 is electrically connected to the inner peripheral surface of the attachment hole, whereby the shielding wall and the shielding layer are electrically connected.

However, the thus configured conventional shield connector includes six parts even as to basic constituent elements thereof (that is, the aforesaid parts depicted by the reference numerals 1 to 6) and the total number of the parts of the shield connector including fine parts other than such basic constituent elements is too much as shown in FIG. 11. Thus, the conventional shield connector has a problem that the number of assembling process is large and the cost thereof is expensive.

SUMMARY OF THE INVENTION

The present invention has been made in view of the aforesaid circumstances and an object of the present invention is to provide a shield connector having small number of parts.

<Invention of Aspect 1>

The shield connector according to the invention as in aspect 1 is arranged in a manner that in the shield connector which covers a shield layer exposed at an end portion of a shield wire thereby to be fixed to the shield wire and is attached to a partner-side shield wall thereby to electrically connect the shield layer and the partner-side shield wall, the shield connector comprises:

- a conductive flange having electrically conductive property and attached to the partner-side shield wall;
- a conductive cylindrical portion provided at the conductive flange in a conductive manner and fitted on an inner or outer peripheral side of the shield layer being exposed thereby to be electrically connected to the shield layer; and
- a housing fixed to the shield wire and holding the conductive flange.

According to the invention, since the flange to be fixed to the partner-side shield wall is made conductive and the shield layer is electrically connected to the conductive flange through the conductive cylindrical portion, the configuration for electrically connecting the shield layer and the partner-side shield wall can be simplified and the number of parts of the shield connector can be reduced.

<Invention of Aspect 2>

The invention of aspect 2 is arranged in the arrangement of aspect 1, wherein the conductive cylindrical portion is provided with an auxiliary sleeve to sandwich the shield layer therebetween.

According to such a configuration, since the shield layer is sandwiched between the conductive cylindrical portion and the auxiliary sleeve, the shield layer can be surely electrically connected to the conductive cylindrical portion.

<Invention of Aspect 3>

The invention of aspect 3 is arranged in the arrangement of aspect 1 in a manner that the conductive cylindrical portion and the shield layer are joined by a fusing process, whereby the shield layer can be surely electrically connected to the conductive cylindrical portion.

<Invention of Aspect 4>

The invention of aspect 4 is arranged in the arrangement of one of aspects 1 to 3 in a manner that the housing is formed in a manner that, in a state where the shield wire is disposed within a die for resin molding, resin in a melted state is filled within the die.

<Invention of Aspect 5>

The invention of aspect 5 is arranged in the arrangement of aspect 4 in a manner that, at an inner peripheral side of a rear end portion of the housing, there is provided with a waterproof cylindrical portion which is formed by molding synthetic resin which is softer than the housing on an outer peripheral surface of the shield wire before forming the housing.

According to such a configuration, since the waterproof cylindrical portion which is softer than the housing is closely in contact with the housing and the shield wire, the rear end portion of the housing is subjected to the waterproof processing.

<Invention of Aspect 6>

The invention of aspect 6 is arranged in the arrangement of aspect 4 or 5 in a manner that a resin flowing hole for passing resin in the melted state therethrough is formed at the conductive flange so as to penetrate it.

According to such a configuration, when the resin in a melted state is filled within the die for resin molding in the state where the shield wire to which the conductive flange is attached is disposed within the die, the resin in the melted state passes through the resin flowing hole formed at the conductive flange, whereby the front side and the rear side of the housing sandwiching the conductive flange therebetween are simultaneously formed.

DETAILED DESCRIPTION OF THE PREFERRED EMBODIMENTS

<First Embodiment>

The first embodiment of the present invention will be explained with reference to FIGS. 1 to 5.

Figure 1:
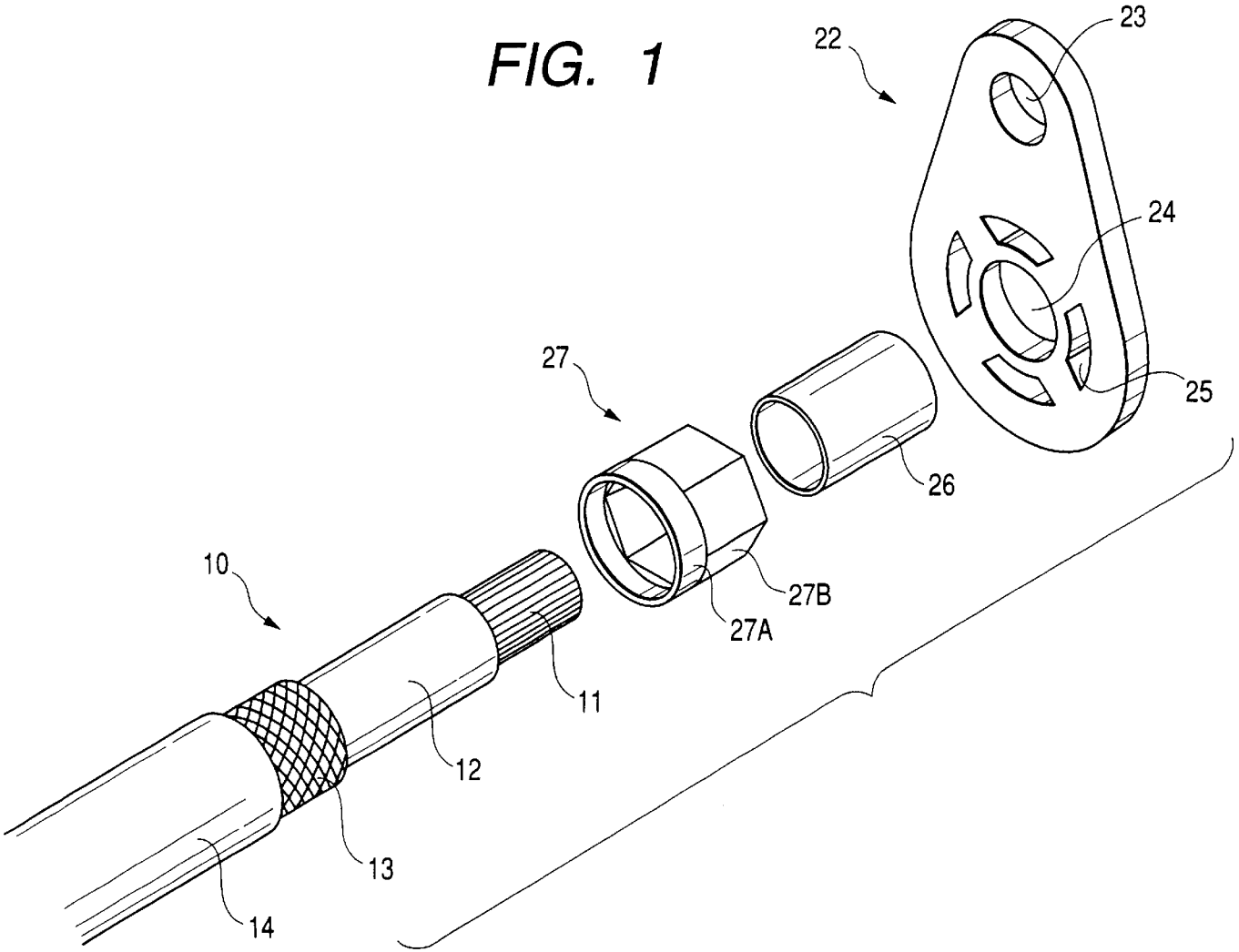
FIG. 1 is a perspective view showing a flange, a conductive sleeve or the like according to the first embodiment of the present invention.

A shield wire 10 includes core wires 11, an inner insulative layer 12, a shield layer 13 and an external sheath 14, from the axle center side thereof as shown in FIG. 1. The core wires 11, the inner insulative layer 12 and the shield layer 13 are sequentially exposed from the tip end sides thereof at the end portion of the shield wire 10.

Figure 2:
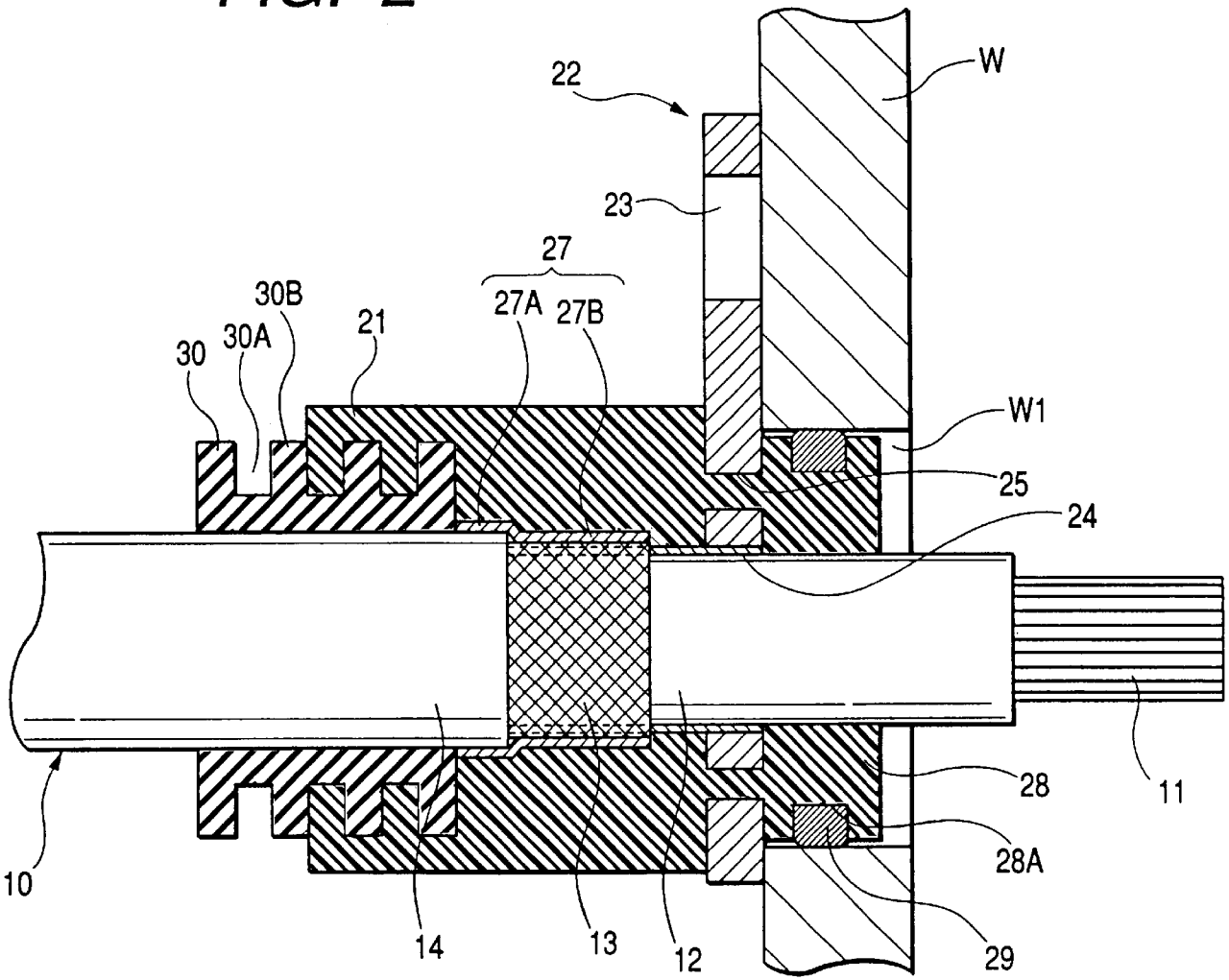
FIG. 2 is a sectional side view showing the shield connector according to the first embodiment.

The shield connector according to this embodiment is integrally attached to the end portion o the shield wire 10 as shown in FIG. 2 illustrating the sectional configuration of the shield connector. As shown by this figure, the shield connector includes a housing 21 made of synthetic resin (for example, polyamide) for covering the shield layer 13 exposed at the end portion of the shield wire 10.

The housing 21 is provided with a conductive flange 22 (hereinafter, merely called as "flange 22" made of metal which is laterally extended from the front side position of the housing. As shown in FIG. 1, the flange 22 is configured in a manner that a metal plate is stamped out in a pear shape, for example, a bolt insertion hole 23 is formed in the pear shaped metal plate at a position closer to one end thereof (upper end in FIG. 1), a wire insertion hole 24 is formed in the pear shaped metal plate at a position closer to the other end thereof, and four resin flowing holes 25 for molding are formed at four equally separated positions of the peripheral area around the wire insertion hole 24. A conductive sleeve 26 made of metal (corresponding to "conductive cylindrical portion" of the invention) is pressed into the wire insertion hole 24. The conductive sleeve 26 is inserted between the shield layer 13 and the inner insulative layer 12 of the shield wire 10. An auxiliary sleeve 27 made of metal is fitted on the outer peripheral side of the shield layer 13. To be more concrete, the auxiliary sleeve 27 is made of metal, a cylindrical portion 27A provided at the one end thereof is fitted on the outer peripheral surface of the external sheath 14 of the shield wire 10, and a hexagonal tubular portion 27B provided at the other end thereof is fitted on the outer exposed peripheral surface of the shield layer 13.

The portion of the housing 21 on the front side from the flange 22 (see FIG. 2) forms an insertion portion 28 to be inserted into an attachment hole W1 formed on a partner-side shield wall W. An O ring 29 is fitted into a groove 28A formed on the outer peripheral surface of the insertion portion.

A waterproof cylindrical portion 30 formed by synthetic resin (for example, urethane) which is softer than the housing 21 is provided on the inner peripheral side of the rear end portion of the housing 21. A plurality of concave portions 30A and a plurality of convex portions 30B are alternately formed on the outer peripheral surface of the waterproof cylindrical portion 30 along the axial direction thereof.

Figure 3A:
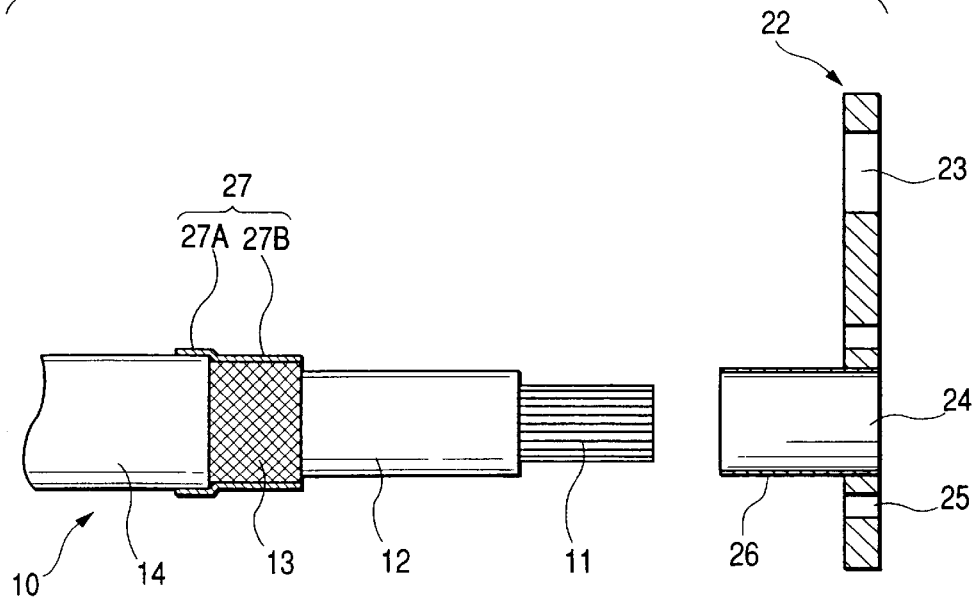
FIG. 3A is a sectional side view showing a state before the flange is assembled with a shield wire.
Figure 3B:
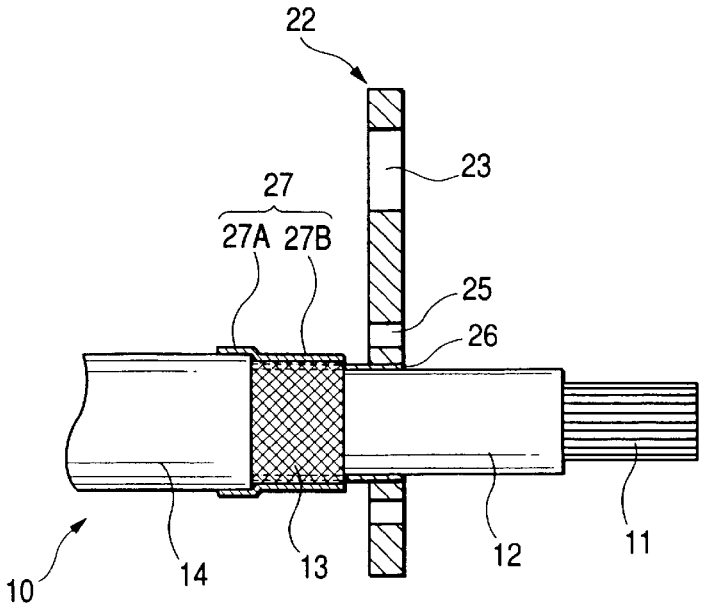
FIG. 3B is a sectional side view showing a state after the flange is assembled with the shield wire.
Figure 5:
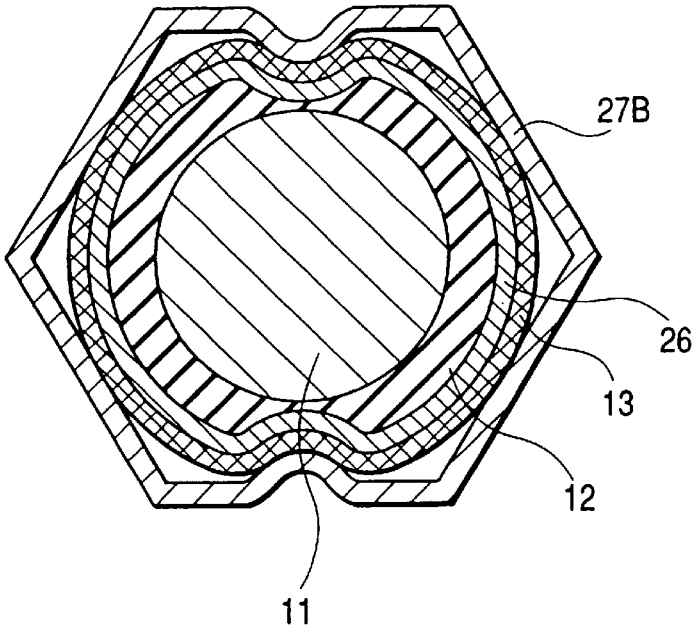
FIG. 5 is a longitudinal sectional view showing a state where an auxiliary sleeve is caulked.

Then, the explanation will be made as to a process of attaching the shield connector of the embodiment to the shield wire 10. First, as shown in FIG. 3A, the shield wire 10 is inserted into the auxiliary sleeve 27 so that the cylindrical portion 27A of the auxiliary sleeve 27 is fitted on the outer peripheral surface of the end portion of the external sheath 14 and the hexagonal tubular portion 27B is fitted on the outer peripheral surface of the shield layer 13. Then, as shown in FIG. 3B, the conductive sleeve 26 having been pressed into the flange 22 is inserted into the shield wire 10 from a tip end side thereof so as to be inserted into the inner side of the shield layer 13. Thereafter, as shown in FIG. 5, the hexagonal tubular portion 27B is caulked in a manner that the upper and lower sides thereof are pressed inside. Thus, the shield layer 13 is sandwiched between the auxiliary sleeve 27 and the conductive sleeve 26 so that the shield layer 13 is electrically connected to these sleeves, whereby the shield layer 13 is electrically connected to the flange 22 through the conductive sleeve 26.

Figure 4A:
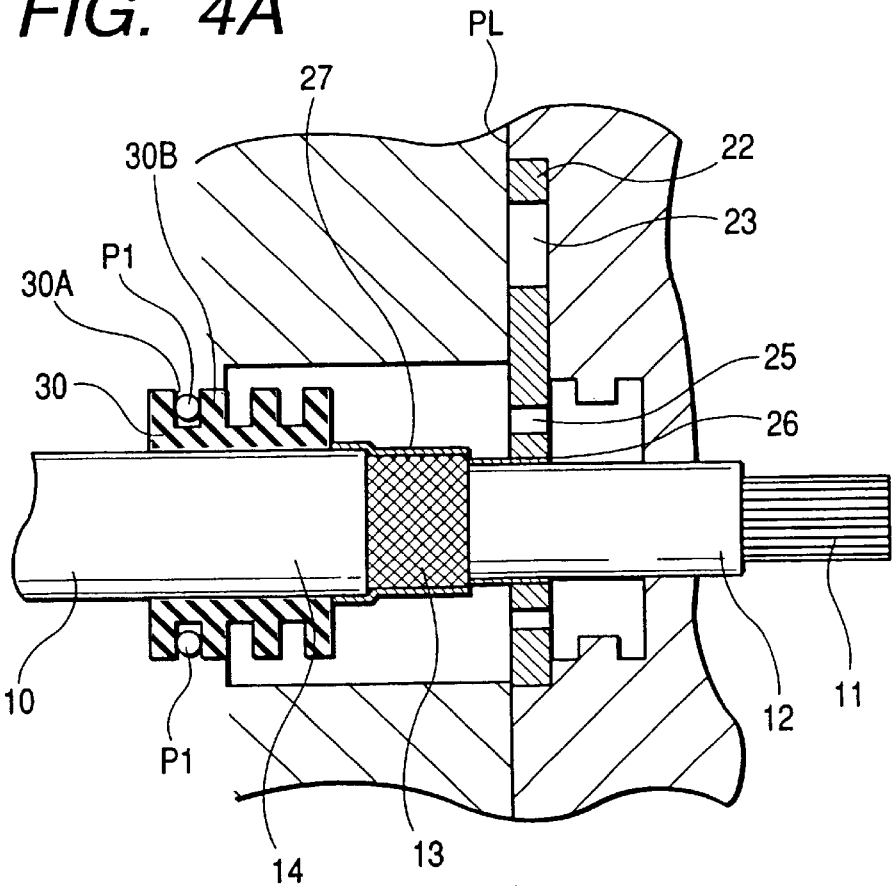
FIG. 4A is a sectional side view showing a state where the end portion of the shield wire is set within a die.
Figure 4B:
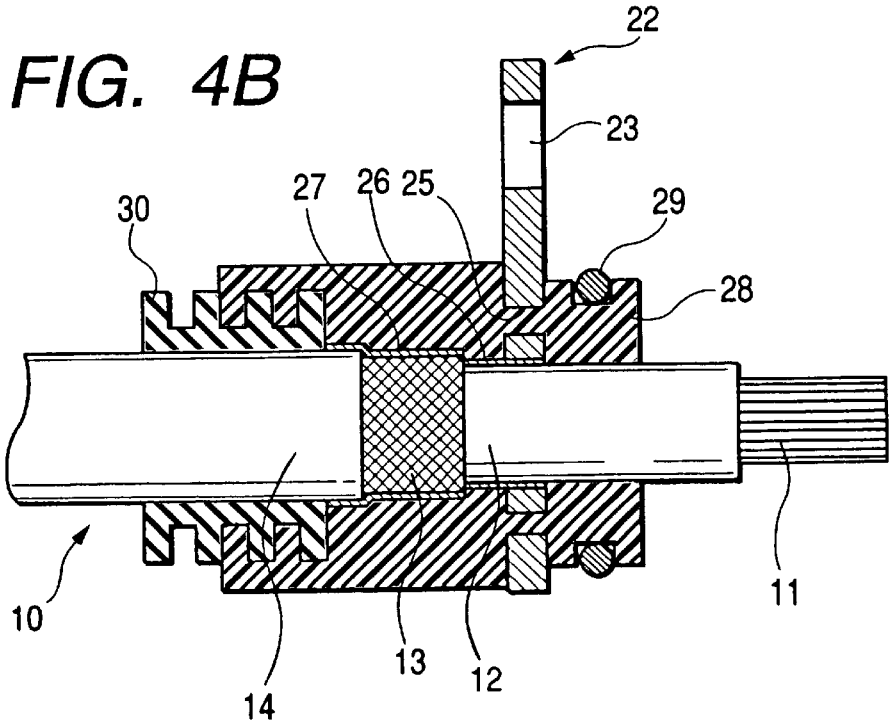
FIG. 4B is a sectional side view showing the completed state of the shield connector.

The shield wire 10 to which the flange 22 etc. are attached is set within a molding die for soft resin. Then, resin (for example, urethane) in a melted state is filled within the die to form the waterproof cylindrical portion 30. Then, the waterproof cylindrical portion thus formed is taken out of the die, and the shield wire 10 is set within a molding die for resin with high rigidity. In this case, as shown in FIG. 4A, pins P1, P1 provided at the die are inserted into concave portions 30A at the rear end side formed on the outer peripheral surface of the waterproof cylindrical portion 30, and the flange 22 is sandwiched by the die parting surfaces PL of the die thereby to fix the waterproof cylindrical portion 30 and the flange 22 in their positions. Then, resin (for example, polyamide) in a melted state is filled within the die. In this case, even if the resin is filled from the rear side of the flange 22 (for example, left side in FIG. 4A) within the resin molding space of the die, the resin spreads to the front side of the flange 22 through the resin flowing holes 25 formed in the flange 22, so that the insertion portion 28 of the shield connector (see FIG. 4B) is formed. The insertion portion thus formed is taken out of the die, and the O ring 29 is fitted on grooves of the outer peripheral surface of the insertion portion 28. In this manner, the assembling process of the shield connector and the attaching process of the shield connector to the wire are completed.

As shown in FIG. 2, the shield connector is fixed to the shield wall W by means of bolts (not shown) in a state that the insertion portion 28 is fitted into the attachment hole W1 formed on the shield wall W of the electric device. Thus, the flange 22 is pressed against the shield wall W thereby to be electrically connected therewith and so the shield layer 13 is electrically connected to the shield wall W. The O ring 29 is pressed between the outer peripheral surface of the insertion portion 28 and the inner peripheral surface of the attachment hole W1 thereby to realize the waterproof property. Further, at the rear end portion of the shield connector, the waterproof cylindrical portion 30 made of the synthetic resin softer than the housing 21 is closely made in contact with the inner peripheral surface of the housing 21 and the outer peripheral surface of the shield wire 10, thereby to prevent the water from entering within the connector from the rear end portion of the shield connector.

According to the embodiment, since the shield connector is configured in a manner that the flange 22 to be fixed to the partner-side shield wall W is made conductive and the shield layer 13 of the shield wire 10 is electrically connected to the conductive sleeve 26 which is pressed into the flange and integrated therewith, the configuration for making conductive between the shield layer 13 and the partner-side shield wall W is simplified and so the number of the parts of the shield connector can be reduced. As a result, the number of assembling processes of the shield connector can be simplified and the cost thereof can be suppressed, and further the shield connector can be miniaturized. Further, according to the shield connector of the embodiment, since both the pressing walls of the flange 22 and the partner-side shield wall W serve as the conductive connecting surfaces between the shield connector and the partner-side shield wall W, the conductive connecting surface having a larger area can be secured as compared with that of the conventional shield connector. Further, in this respect, since the pressing walls of the flange and the partner-side shield wall are closely contacted by the fastening of the bolts, the stability of the conductivity between the shield connector and the partner-side shield wall W can be improved as compared with the conventional shield connector.

<Second Embodiment>

Figure 6:
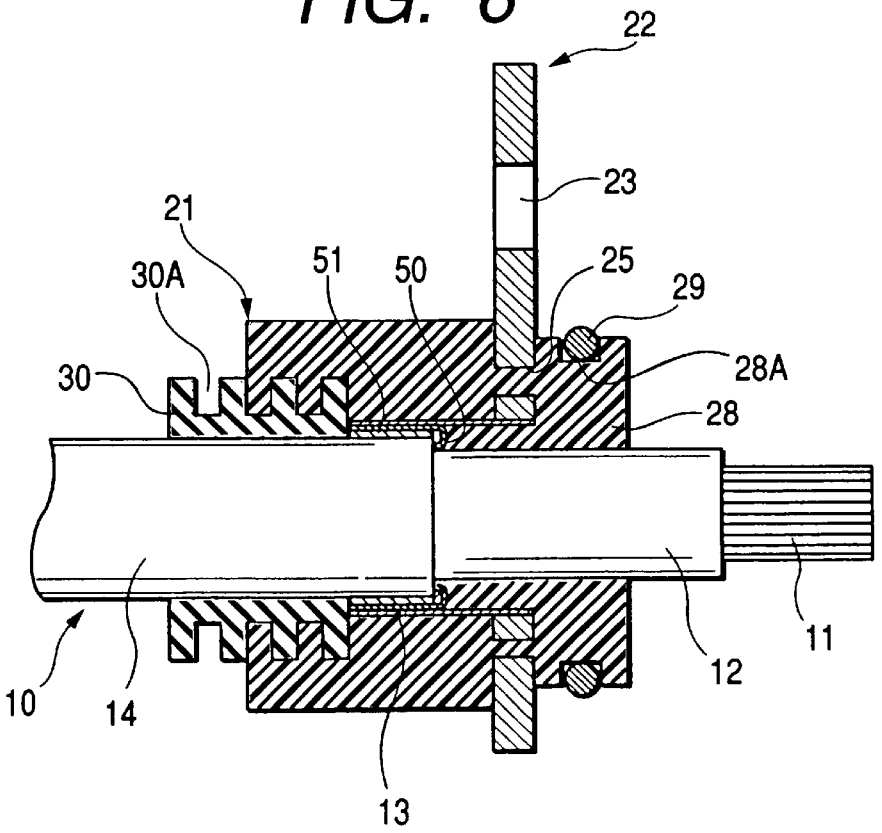
FIG. 6 is a sectional side view showing the shield connector according to the second embodiment.

The second embodiment is shown in FIGS. 6 and 7 and arranged in a manner that the configuration of a conductive sleeve 50 and an auxiliary sleeve 51 is different from that of the first embodiment. However, since other configuration of this embodiment is same as that of the first embodiment, portions identical to those of the first embodiment are referred to by the common symbols, with explanation thereof being omitted.

Figure 7A:
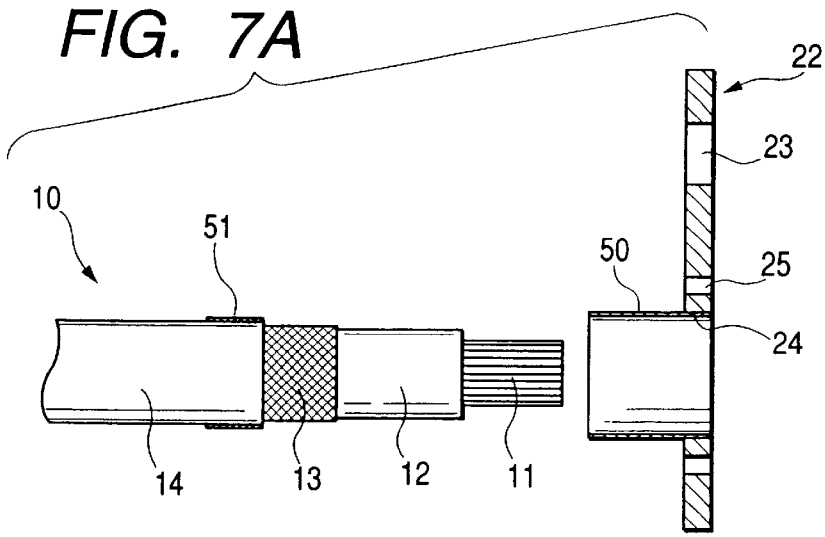
FIG. 7 is a sectional side view showing a state where the shield connector is on the way of being assembled.
Figure 7B:
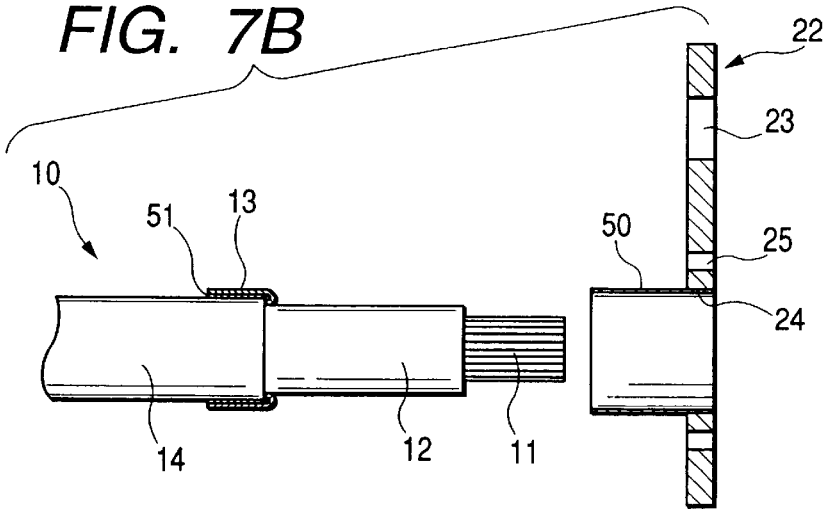
Figure 7C:
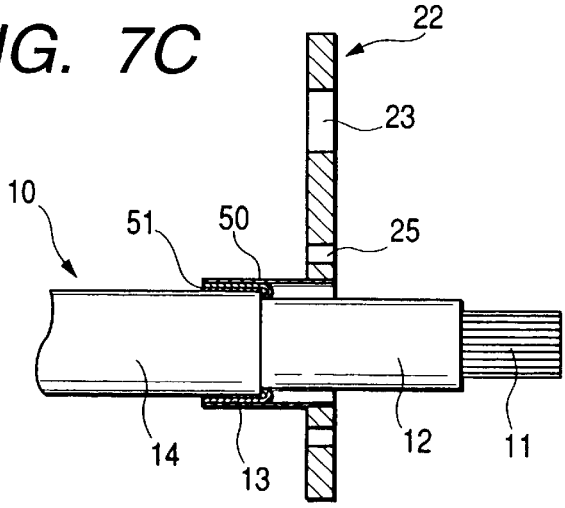

The auxiliary sleeve 51 of this embodiment is formed in a cylindrical configuration and fitted on the outer peripheral surface of the external sheath 14 of the shield wire 10 as shown in FIG. 7A. Then, as shown in FIG. 7B, the shield layer 13 is tucked or turned up so as to cover the outer periphery of the auxiliary sleeve 51. In this state, when the shield wire 10 is fitted into the conductive sleeve 50, the conductive sleeve 50 is just fitted on the outer peripheral side of the shield layer 13 as shown in FIG. 7C, whereby the shield layer 13 is sandwiched between the conductive sleeve 50 and the auxiliary sleeve 51. Thereafter, the waterproof cylindrical portion 30 and the housing 21 are formed in the similar manner as the first embodiment, whereby the shield connector of this embodiment is completed (see FIG. 6). When the shield connector of this embodiment is configured in this manner, this embodiment can attain the similar action and effects as the first embodiment.

<Third Embodiment>

Figure 8:
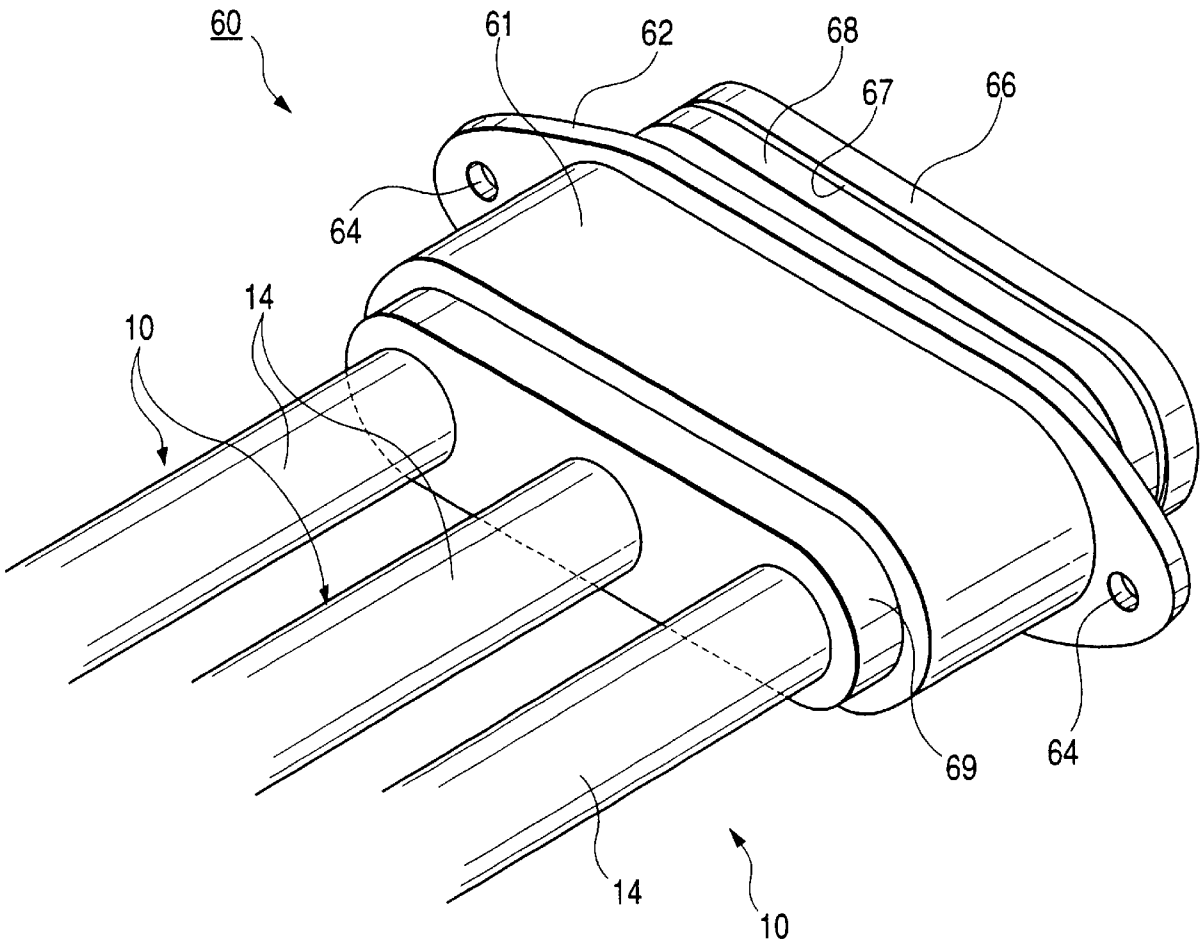
FIG. 8 is a perspective view of the third embodiment.
Figure 9:
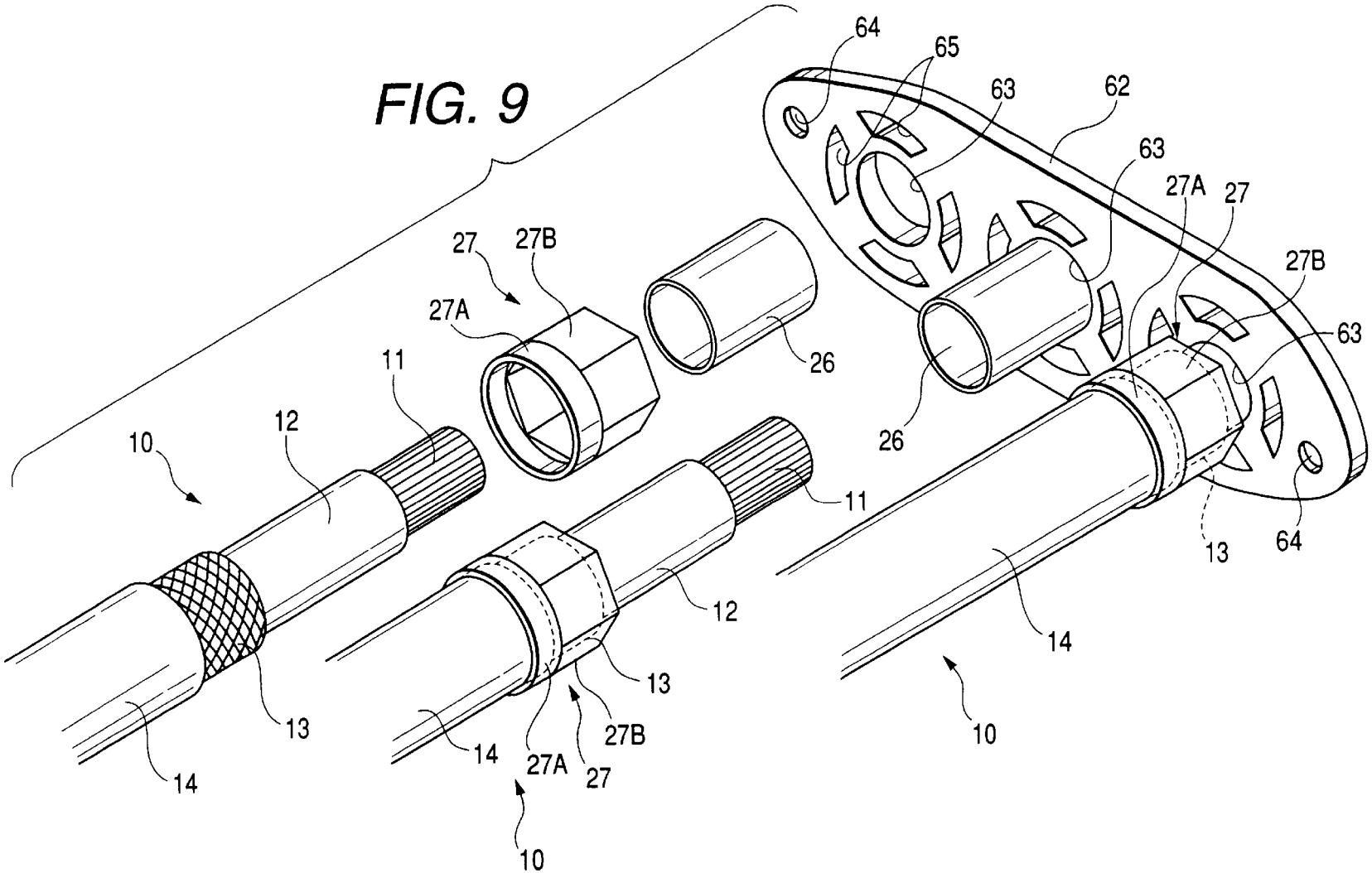
FIG. 9 is a perspective view showing a state where the shield connector of the third embodiment is on the way of being assembled.
Figure 10:
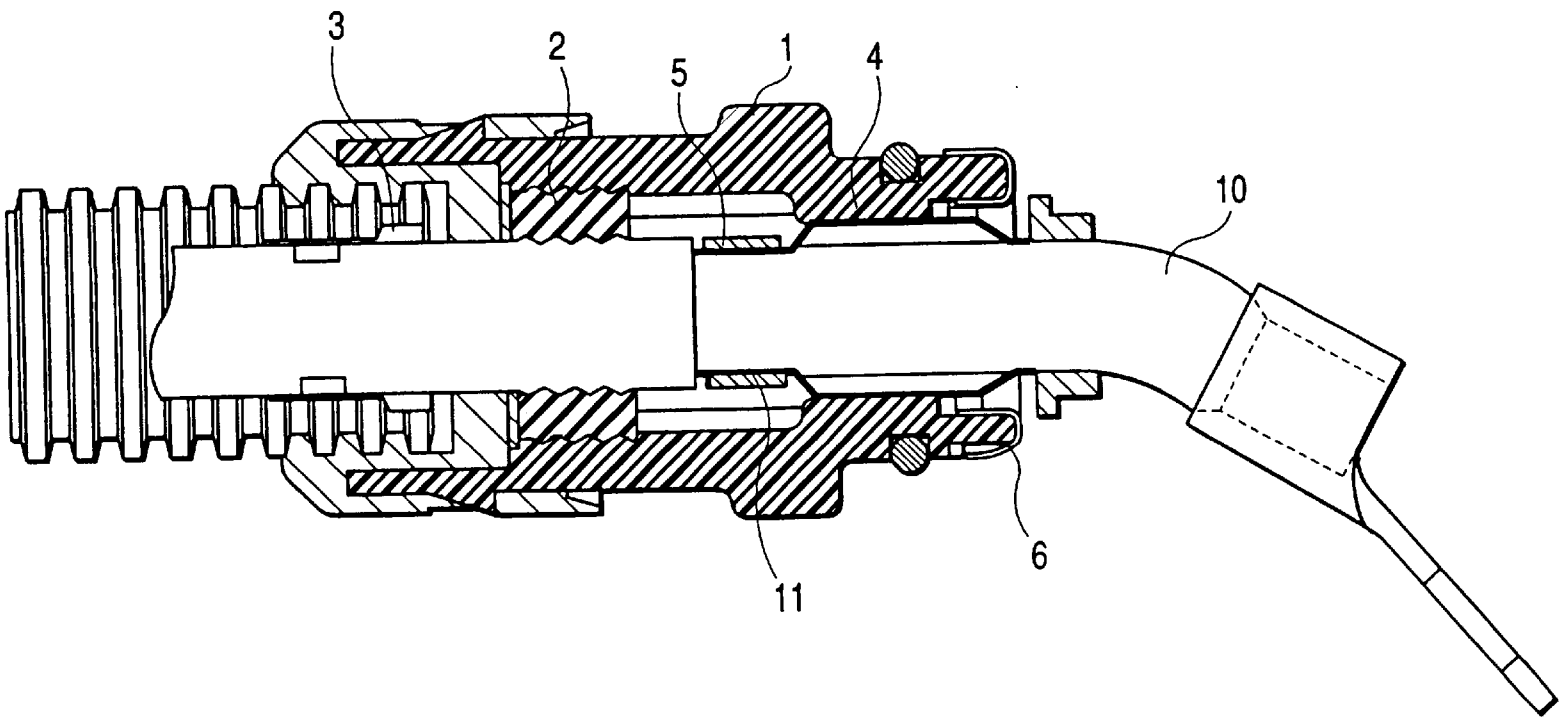
FIG. 10 PRIOR ART
FIG. 10 is a sectional side view of a conventional shield connector.
Figure 11:
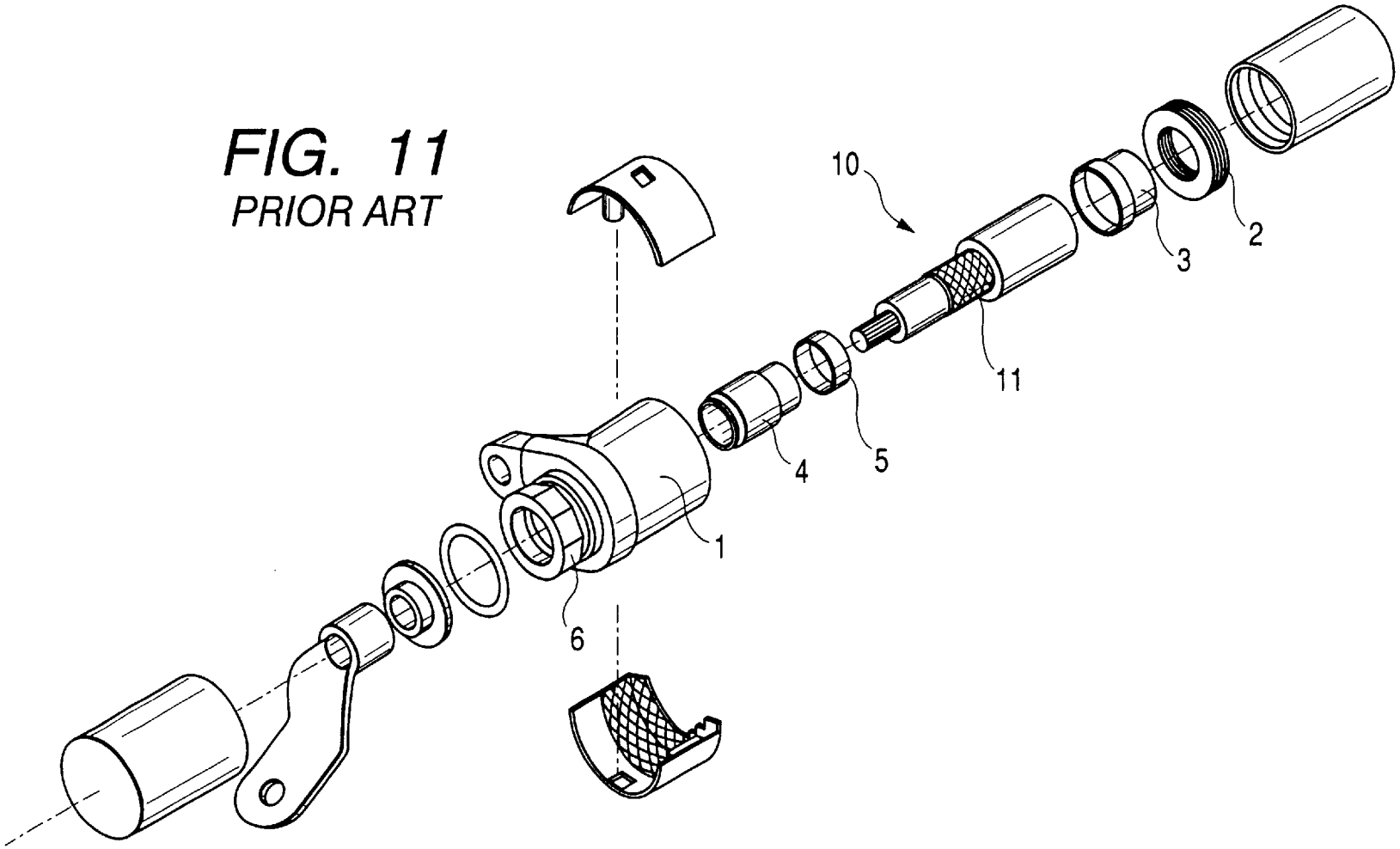
FIG. 11 PRIOR ART
FIG. 11 is an exploded perspective view of the conventional shield connector.

The third embodiment of the invention will be explained with reference to FIGS. 8 and 9.

The shield connector 60 of this embodiment is arranged to include a housing 61 and a sheet of conductive flange 62 (material of which is copper, copper alloy, iron, stainless steel or the like, for example) thereby to integrally couple three shield wires 10 to the connector. In this embodiment, since a conductive sleeve 26 and an auxiliary sleeve 27 used for attaching the shield wires 10 and for attaching the shield wires 10 and the shield connector 60 are same as those of the first embodiment, these elements are referred to by the common symbols.

The conductive flange 62 is formed in an elongated plate shape as a whole and configured in a manner that three circular wire through holes 63 are formed at a constant pitch along the longitudinal direction thereof and a pair of bolt through holes 64 are formed at both end positions thereof sandwiching the three wire through holes 63, respectively. Arc-shaped resin flowing holes 65 are formed at equally separated positions along the circumferential direction at the peripheral area around each of the wire through holes 63. The circular conductive sleeve 26 made of metal is pressed into each of the wire through holes 63 and inserted between the shield layer 13 and the inner insulative layer 12 of the corresponding shield wire 10. The auxiliary sleeve 27 made of metal is fitted on the outer periphery of the shield layer 13 of each of the shield wire.

The housing 61 is formed in an elongated ellipse shape seen from the axial direction of the shield wire 10. The portion of the housing 61 extended to the front side (right upper side in FIGS. 8 and 9) from the conductive flange 62 serves as an insertion portion 66 of an ellipse shape to be inserted into an attachment hole W1 formed on a partner-side shield wall W (not shown in FIGS. 8 and 9). An O ring 68 is fitted into a groove 67 formed on the outer periphery of the insertion portion 66. A waterproof portion 69 of an ellipse shape formed by synthetic resin (for example, urethane) which is softer than the housing 61 is provided on the inner peripheral side of the rear end portion of the housing 61.

Then, the explanation will be made as to a process of attaching the shield connector 60 of the embodiment to the shield wires 10. First, like the first embodiment, the auxiliary sleeves 27 are fitted on the outer peripheries of the shield wires 10, respectively. The conductive sleeves 26 are pressed into the wire through holes 63, respectively (see the shield wire 10 and the wire through hole 63 located at the center position in FIG. 9). Then, the tip portion of each of the shield wires 10 is inserted into the corresponding conductive sleeve 26, and the rear end portion of each of the conductive sleeves 26 is inserted between the shield layer 13 and the inner insulative layer 12 of the corresponding shield wire (see the shield wire 10 and the wire through hole 63 located at the right side in FIG. 9). Thereafter, the hexagonal tubular portion 27B of each of the auxiliary sleeves 27 is caulked to the corresponding shield wire 10 thereby to connect the shield layers 13 to the conductive flange 62 through the conductive sleeves 26 in a conductive state.

The conductive flange 62 etc. to which the three shield wires 10 are attached in this manner are set within a molding die for soft resin. Then, resin in a melted state is filled within the die to form the waterproof portion 69. Thereafter, the waterproof cylindrical portion etc. thus formed are taken out of the die and set within a molding die for resin with high rigidity. Then, resin (for example, polyamide) in a melted state is filled within the die to form the housing 61 and the insertion portion 66. Thereafter, the housing etc. thus formed are taken out of the die and the O ring 68 is attached to the insertion portion 66. In this manner, the connecting process of the three shield wires 10 to the shield connector 60 is completed.

According to this embodiment, since the three shield wires 10 are collectively connected to the shield connector 60, the shield connector of the embodiment is suitable for use in a three-phase AC circuit, for example. Further, the embodiment can reduce the number of the parts, reduce the number of assembling processes and miniaturize the size of the shield connector as compared with the configuration where the shield wires 10 are separately connected to the shield connectors one by one.

Although, in this embodiment, the waterproof portion 69 made of soft resin is provided on the inner periphery of the rear end portion of the housing 61, the shield connector may be configured not to include the waterproof portion. In this case, material such as urethane, PBT, polyamides or the like may be employed as the resin material of the housing 61.

<Other Embodiments>

The present invention is not limited to the aforesaid embodiments and such embodiments as explained below are also contained in the technical teaching of the present invention, and further, in addition to the following embodiments, various changes in the arrangement may be resorted to without departing from the spirit and the scope of the invention.

(1) The shield connector may be arranged in a manner that the auxiliary sleeve 27 of the first embodiment is not provided and the shield layer 13 of the shield wire 10 may be joined to the conductive sleeve 26 by a fusing process. According to such a configuration, the number of the parts of the shield connector can be further reduced.

(2) Although the flange 22 is formed by stamping out the metal plate, the flange may be formed by electroplating resin with conductive metal, for example.

(3) Although the conductive sleeve 26 of the first embodiment is pressed into the flange 22 and integrated therewith, the conductive sleeve 26 and the flange 22 may be integrated by conductive adhesive, welding or deep-drawing pressing, for example.

What is claimed is:

1. A shield connector which covers a shield layer exposed at an end portion of a shield wire to be fixed to the shield wire and is attached to a partner-side shield wall to electrically connect the shield layer and the partner-side shield wall, said shield connector comprising:

a conductive flange having electrically conductive property and attached to the partner-side shield wall;

a conductive cylindrical portion provided at said conductive flange in a conductive manner and fitted on an inner or outer peripheral side of the shield layer being exposed to be electrically connected to the shield layer; and a housing fixed to the shield wire and holding said conductive flange;

wherein the shield layer is rigidly fixed with respect to the conductive flange.

2. The shield connector according to claim 1, further comprising an auxiliary sleeve, the shield layer being sandwiched between the auxiliary sleeve and the conductive cylindrical portion.

3. The shield connector according to claim 1, wherein said conductive cylindrical portion and the shield layer are joined by a fusing process.

4. The shield connector according to claim 1, wherein said housing is formed in a manner that, in a state where the shield wire is disposed in a die for resin molding, resin in a melted state is filled in said die.

5. The shield connector according to claim 4, further comprising:

at an inner peripheral side of a rear end portion of said housing, a waterproof cylindrical portion formed by molding synthetic resin which is softer than said housing on an outer peripheral surface of the shield wire before forming said housing.

6. The shield connector according to claim 4, wherein a resin flowing hole for passing resin in a melted state therethrough is formed through said conductive flange.

7. The shield connector according to claim 2, wherein the auxiliary sleeve is separate from the conductive cylindrical portion.

8. A shield connector which covers a shield layer exposed at an end portion of a shield wire to be fixed to the shield wire and is attached to a partner-side shield wall to electrically connect the shield layer and the partner-side shield wall, said shield connector comprising:

a conductive flange having electrically conductive property and attached to the partner-side shield wall;

a conductive cylindrical portion directly contacting said conductive flange in a conductive manner and fitted on an inner or outer peripheral side of the shield layer being exposed to be electrically connected to the shield layer; and a housing fixed to the shield wire and holding said conductive flange.

9. A shield connector which covers a shield layer exposed at an end portion of a shield wire to be fixed to the shield wire and is attached to a partner-side shield wall to electrically connect the shield layer and the partner-side shield wall, said shield connector comprising:

a conductive flange having electrically conductive property and attached to the partner-side shield wall;

a conductive cylindrical portion provided at said conductive flange in a conductive manner and fitted on an inner or outer peripheral side of the shield layer being exposed to be electrically connected to the shield layer; and a housing fixed to the shield wire and molded together with said conductive flange.

10. The shield connector according to claim 1, further comprising a waterproof cylindrical portion, made of synthetic resin which is softer than said housing, positioned between an outer peripheral surface of the shield wire and an inner peripheral side of the housing.

11. The shield connector according to claim 10, wherein the inner peripheral side of the housing comprises concave portions that interlock with the waterproof cylindrical portion.

12. A shield connector which covers a shield layer exposed at an end portion of a shield wire to be fixed to the shield wire and is attached to a partner-side shield wall to electrically connect the shield layer and the partner-side shield wall, said shield connector comprising:

a conductive flange having electrically conductive property and attached to the partner-side shield wall;

a conductive cylindrical portion provided at said conductive flange in a conductive manner and fitted on an inner or outer peripheral side of the shield layer being exposed to be electrically connected to the shield layer; and a housing of synthetic resin material fixed to the shield wire and holding said conductive flange.

13. The shield connector according to claim 8, further comprising an auxiliary sleeve, the shield layer being sandwiched between the auxiliary sleeve and the conductive cylindrical portion.

14. The shield connector according to claim 8, wherein said conductive cylindrical portion and the shield layer are joined by a fusing process.

15. The shield connector according to claim 8, wherein said housing is formed in a manner that, in a state where the shield wire is disposed in a die for resin molding, resin in a melted state is filled in said die.

16. The shield connector according to claim 15, further comprising:

at an inner peripheral side of a rear end portion of said housing, a waterproof cylindrical portion formed by molding synthetic resin which is softer than said housing on an outer peripheral surface of the shield wire before forming said housing.

17. The shield connector according to claim 15, wherein a resin flowing hole for passing resin in a melted state therethrough is formed through said conductive flange.

18. The shield connector according to claim 13, wherein the auxiliary sleeve is separate from the conductive cylindrical portion.

19. The shield connector according to claim 8, further comprising a waterproof cylindrical portion, made of synthetic resin which is softer than said housing, positioned between an outer peripheral surface of the shield wire and an inner peripheral side of the housing.

20. The shield connector according to claim 19, wherein the inner peripheral side of the housing comprises concave portions that interlock with the waterproof cylindrical portion.

21. A shield connector which covers a shield layer exposed at an end portion of a shield wire to be fixed to the shield wire and is attached to a partner-side shield wall to electrically connect the shield layer and the partner-side shield wall, said shield connector comprising:

a conductive flange having electrically conductive property and attached to the partner-side shield wall, a resin flowing hole for passing resin in a melted state being formed through said conductive flange;

a conductive cylindrical portion provided at said conductive flange in a conductive manner and fitted on an inner or outer peripheral side of the shield layer being exposed to be electrically connected to the shield layer; and a housing fixed to the shield wire and holding said conductive flange, said housing being formed in a manner that, in a state where the shield wire is disposed in a die for resin molding, resin in a melted state is filled in said die.

* * * * *